US009212411B2

(12) United States Patent
Nakagawa et al.

(10) Patent No.: US 9,212,411 B2
(45) Date of Patent: Dec. 15, 2015

(54) HIGH STRENGTH STEEL SHEET AND METHOD FOR MANUFACTURING THE SAME

(75) Inventors: Koichi Nakagawa, Tokyo (JP); Takeshi Yokota, Tokyo (JP); Kazuhiro Seto, Tokyo (JP); Satoshi Kinoshiro, Tokyo (JP); Yuji Tanaka, Tokyo (JP); Katsumi Yamada, Tokyo (JP); Tetsuya Mega, Tokyo (JP); Katsumi Nakajima, Tokyo (JP)

(73) Assignee: JFE Steel Corporation (JP)

( * ) Notice: Subject to any disclaimer, the term of this patent is extended or adjusted under 35 U.S.C. 154(b) by 1018 days.

(21) Appl. No.: 13/381,992

(22) PCT Filed: Jun. 29, 2010

(86) PCT No.: PCT/JP2010/061363

§ 371 (c)(1),
(2), (4) Date: Jan. 3, 2012

(87) PCT Pub. No.: WO2011/004779

PCT Pub. Date: Jan. 13, 2011

(65) Prior Publication Data

US 2012/0107633 A1 May 3, 2012

(30) Foreign Application Priority Data

Jul. 10, 2009 (JP) ..... 2009-163309

(51) Int. Cl.

| | |
|---|---|
| ***C21D 9/28*** | (2006.01) |
| ***C22C 38/12*** | (2006.01) |
| ***C22C 38/02*** | (2006.01) |
| ***C21D 8/02*** | (2006.01) |
| ***C22C 38/04*** | (2006.01) |
| ***C22C 38/06*** | (2006.01) |
| ***C22C 38/14*** | (2006.01) |
| ***C22C 38/24*** | (2006.01) |
| ***C22C 38/28*** | (2006.01) |

(52) U.S. Cl.

CPC ..... *C22C 38/02* (2013.01); *C21D 8/0226* (2013.01); *C21D 8/0273* (2013.01); *C22C 38/04* (2013.01); *C22C 38/06* (2013.01); *C22C 38/12* (2013.01); *C22C 38/14* (2013.01); *C22C 38/24* (2013.01); *C22C 38/28* (2013.01); *C21D 2211/004* (2013.01); *C21D 2211/005* (2013.01); *Y10T 428/12229* (2015.01)

(58) Field of Classification Search

CPC ..... C22C 38/00; C22C 38/02; C22C 38/04; C22C 38/12; C22C 38/14; C21D 2211/005

See application file for complete search history.

(56) References Cited

U.S. PATENT DOCUMENTS

| | | | | |
|---|---|---|---|---|
| 2010/0196189 | A1 * | 8/2010 | Nakagawa et al. | 420/114 |
| 2011/0271733 | A1 * | 11/2011 | Yokota et al. | 72/364 |

FOREIGN PATENT DOCUMENTS

| | | | | | |
|---|---|---|---|---|---|
| JP | 4-289120 | A | | 10/1992 | |
| JP | 2003-096543 | A | | 4/2003 | |
| JP | 2003-105444 | A | | 4/2003 | |
| JP | 2004-143518 | A | | 5/2004 | |
| JP | 2004-360046 | A | | 12/2004 | |
| JP | 2005-002406 | A | | 1/2005 | |
| JP | 2005-232567 | A | | 9/2005 | |
| JP | 2006-161111 | A | * | 6/2006 | C22C 38/00 |
| JP | 2006-161111 | A | | 6/2006 | |
| JP | 2006-161112 | A | | 6/2006 | |
| JP | 2006-183138 | A | | 7/2006 | |
| JP | 2006-183139 | A | | 7/2006 | |
| JP | 2007-009322 | A | | 1/2007 | |
| JP | 2007-016319 | A | | 1/2007 | |
| JP | 2007-063668 | A | | 3/2007 | |
| JP | 2009-007659 | A | | 1/2009 | |
| JP | 2009-052139 | A | | 3/2009 | |
| JP | 2009-084643 | A | | 4/2009 | |
| JP | 2009-167475 | A | * | 7/2009 | C22C 38/00 |
| JP | 2009-167475 | A | | 7/2009 | |
| WO | WO2009/017256 | A1 | * | 2/2009 | C22C 38/14 |
| WO | WO2009/028515 | A1 | * | 3/2009 | C21D 9/46 |

OTHER PUBLICATIONS

Supplementary European Search Report dated May 28, 2014 from corresponding European Patent Application No. EP 10 79 7090.

* cited by examiner

*Primary Examiner* — Scott Kastler
*Assistant Examiner* — Vanessa Luk
(74) *Attorney, Agent, or Firm* — DLA Piper LLP (US)

(57) ABSTRACT

A high-strength steel sheet includes a composition containing, in mass percent, 0.08% to 0.20% of carbon, 0.2% to 1.0% of silicon, 0.5% to 2.5% of manganese, 0.04% or less of phosphorus, 0.005% or less of sulfur, 0.05% or less of aluminum, 0.07% to 0.20% of titanium, and 0.20% to 0.80% of vanadium, the balance being iron and incidental impurities.

8 Claims, 4 Drawing Sheets

HIGH STRENGTH STEEL SHEET AND METHOD FOR MANUFACTURING THE SAME

RELATED APPLICATIONS

This is a §371 of International Application No. PCT/JP2010/061363, with an international filing date of Jun. 29, 2010 (WO 2011/004779 A1, published Jan. 13, 2011), which is based on Japanese Patent Application No. 2009-163309, filed Jul. 10, 2009, the subject matter of which is incorporated by reference.

TECHNICAL FIELD

This disclosure relates to high-strength steel sheets having excellent stretch flangeability after working and a tensile strength (TS) of 980 MPa or more and methods for manufacturing such high-strength steel sheets.

BACKGROUND

Conventionally, 590 MPa grade steels have been used for automotive chassis and impact members such as bumpers and center pillars because they demand formability (mainly ductility and stretch flangeability). Recently, however, the use of automotive steel sheets with higher strengths has been promoted to reduce the effects of automobiles on the environment and to improve crashworthiness, and research on the use of 980 MPa grade steels has been started. In general, a steel sheet having a higher strength has a lower workability. Therefore, steel sheets having high strength and high workability have been currently researched. Examples of techniques for improving ductility and stretch flangeability include the following techniques.

Japanese Unexamined Patent Application Publication No. 2007-063668 discloses a technique related to a high-tensile-strength steel sheet having a tensile strength of 980 MPa or more, the steel sheet being composed substantially of a ferritic single-phase structure and having carbides of an average grain size of less than 10 nm precipitated and dispersed therein, the carbides containing titanium, molybdenum, and vanadium and having an average composition satisfying $V/(Ti+Mo+V)\geq 0.3$, where Ti, Mo, and V are expressed in atomic percent.

Japanese Unexamined Patent Application Publication No. 2006-161112 discloses a technique related to a high-strength hot-rolled steel sheet having a strength of 880 MPa or more and a yield ratio of 0.80 or more, the steel sheet having a steel composition containing, by mass, 0.08% to 0.20% of carbon, 0.001% to less than 0.2% of silicon, more than 1.0% to 3.0% of manganese, 0.001% to 0.5% of aluminum, more than 0.1% to 0.5% of vanadium, 0.05% to less than 0.2% of titanium, and 0.005% to 0.5% of niobium and satisfying inequalities (a), (b), and (c), the balance being iron and impurities, and a steel structure containing 70% by volume or more of ferrite having an average grain size of 5 μm or less and a hardness of 250 Hv or more:

$$9(Ti/48+Nb/93)\times C/12\leq 4.5\times 10^{-5} \quad \text{Inequality (a):}$$

$$0.5\%\leq (V/51+Ti/48+Nb/93)/(C/12)\leq 1.5 \quad \text{Inequality (b):}$$

$$V+Ti\times 2+Nb\times 1.4+C\times 2+Mn\times 0.1\geq 0.80. \quad \text{Inequality (c):}$$

Japanese Unexamined Patent Application Publication No. 2004-143518 discloses a technique related to a hot-rolled steel sheet containing, in mass percent, 0.05% to 0.2% of carbon, 0.001% to 3.0% of silicon, 0.5% to 3.0% of manganese, 0.001% to 0.2% of phosphorus, 0.001% to 3% of aluminum, more than 0.1% to 1.5% of vanadium, and optionally 0.05% to 1.0% of molybdenum, the balance being iron and impurities, the steel sheet having a structure containing ferrite having an average grain size of 1 to 5 μm as a primary phase, the ferrite grains containing vanadium carbonitrides having an average grain size of 50 nm or less.

Japanese Unexamined Patent Application Publication No. 2004-360046 discloses a technique related to a high-strength steel sheet having a tensile strength of 880 MPa or more in a direction perpendicular to a rolling direction and a yield ratio of 0.8 or more, the steel sheet having a steel composition containing, in mass percent, 0.04% to 0.17% of carbon, 1.1% or less of silicon, 1.6% to 2.6% of manganese, 0.05% or less of phosphorus, 0.02% or less of sulfur, 0.001% to 0.05% of aluminum, 0.02% or less of nitrogen, 0.11% to 0.3% of vanadium, and 0.07% to 0.25% of titanium, the balance being iron and incidental impurities.

Japanese Unexamined Patent Application Publication No. 2005-002406 discloses a technique related to a high-strength hot-rolled steel sheet having a strength of 880 MPa or more and a yield ratio of 0.80 or more, the steel sheet having a steel composition containing, in mass percent, 0.04% to 0.20% of carbon, 0.001% to 1.1% of silicon, more than 0.8% of manganese, 0.05% to less than 0.15% of titanium, and 0% to 0.05% of niobium and satisfying inequalities (d), (e), and (f), the balance being iron and incidental impurities:

$$(Ti/48+Nb/93)\times C/12\leq 3.5\times 10^{-5} \quad \text{Inequality (d):}$$

$$0.4\leq (V/51+Ti/48+Nb/93)/(C/12)\leq 2.0 \quad \text{Inequality (e):}$$

$$V+Ti\times 2+Nb\times 1.4+C\times 2+Si\times 0.2+Mn\times 0.1\geq 0.7. \quad \text{Inequality (f):}$$

Japanese Unexamined Patent Application Publication No. 2005-232567 discloses a technique related to an ultrahigh-tensile-strength steel sheet with excellent stretch flangeability having a tensile strength of 950 MPa or more, the steel sheet being composed substantially of a ferritic single-phase structure, the ferritic structure having precipitates containing titanium, molybdenum, and carbon precipitated therein, wherein the area fraction of <110> colonies of adjacent crystal grains in a region between a position one-fourth of the thickness and a position three-fourths of the thickness in a cross section perpendicular to a vector parallel to a rolling direction is 50% or less.

Japanese Unexamined Patent Application Publication No. 2006-183138 discloses a technique related to a steel sheet having a composition containing, in mass percent, 0.10% to 0.25% of carbon, 1.5% or less of silicon, 1.0% to 3.0% of manganese, 0.10% or less of phosphorus, 0.005% or less of sulfur, 0.01% to 0.5% of aluminum, 0.010% or less of nitrogen, and 0.10% to 1.0% of vanadium and satisfying $(10Mn+V)/C\geq 50$, the balance being iron and incidental impurities, wherein the average grain size of carbides containing vanadium determined for precipitates having a grain size of 80 nm or less is 30 nm or less.

Japanese Unexamined Patent Application Publication No. 2006-183139 discloses a technique related to an automotive member having a composition containing, in mass percent, 0.10% to 0.25% of carbon, 1.5% or less of silicon, 1.0% to 3.0% of manganese, 0.10% or less of phosphorus, 0.005% or less of sulfur, 0.01% to 0.5% of aluminum, 0.010% or less of nitrogen, and 0.10% to 1.0% of vanadium and satisfying $(10Mn+V)/C\geq 50$, the balance being iron and incidental impurities, wherein the volume fraction of tempered martensite phase is 80% or more, and the average grain size of carbides containing vanadium and having a grain size of 20 nm or less is 10 nm or less.

Japanese Unexamined Patent Application Publication No. 2007-016319 discloses a technique related to high-tensile-strength hot-dip galvanized steel sheet having a hot-dip galvanized layer thereon, the steel sheet having a chemical composition containing, in mass percent, more than 0.02% to 0.2% of carbon, 0.01% to 2.0% of silicon, 0.1% to 3.0% of manganese, 0.003% to 0.10% of phosphorus, 0.020% or less of sulfur, 0.001% to 1.0% of aluminum, 0.0004% to 0.015% of nitrogen, and 0.03% to 0.2% of titanium, the balance being iron and impurities, the steel sheet having a metallographic structure containing 30% to 95% by area of ferrite, wherein if second phases in the balance include martensite, bainite, pearlite, and cementite, the area fraction of martensite is 0% to 50%, the steel sheet containing titanium-based carbonitride precipitates having a grain size of 2 to 30 nm with an average intergrain distance of 30 to 300 nm and crystallized TiN having a grain size of 3 μm or more with an average intergrain distance of 50 to 500 μm.

Japanese Unexamined Patent Application Publication No. 2003-105444 discloses a technique related to a method for improving the fatigue resistance of a steel sheet, including subjecting a steel sheet to strain aging treatment to form fine precipitates having a grain size of 10 nm or less, the steel sheet having a composition containing, in mass percent, 0.01% to 0.15% of carbon, 2.0% or less of silicon, 0.5% to 3.0% of manganese, 0.1% or less of phosphorus, 0.02% or less of sulfur, 0.1% or less of aluminum, 0.02% or less of nitrogen, and 0.5% to 3.0% of copper and having a multiphase structure containing ferrite phase as a primary phase and a phase containing 2% by area or more of martensite phase as a second phase.

Japanese Unexamined Patent Application Publication No. 4-289120 discloses a technique related to a method for manufacturing an ultrahigh-strength cold-rolled steel sheet with good formability and strip shape having a fine two-phase structure containing 80% to 97% by volume of martensite, the balance being ferrite, and a tensile strength of 150 to 200 $kgf/mm^2$, the method including hot-rolling a steel at a finishing temperature higher than or equal to the Ar3 point, coiling the steel at 500° C. to 650° C., pickling the steel, cold-rolling the steel, performing continuous annealing by heating the steel to Ac3 to [Ac3+70° C.] and soaking the steel for 30 seconds or more, performing first cooling to precipitate 3% to 20% by volume of ferrite, quenching the steel to room temperature in a jet of water, and subjecting the steel to overaging treatment at 120° C. to 300° C. for 1 to 15 minutes, the steel containing, in mass percent, 0.18% to 0.3% of carbon, 1.2% or less of silicon, 1% to 2.5% of manganese, 0.02% or less of phosphorus, 0.003% or less of sulfur, and 0.01% to 0.1% of dissolved aluminum and further containing one or more of 0.005% to 0.030% of niobium, 0.01% to 0.10% of vanadium, and 0.01% to 0.10% of titanium in a total amount of 0.005% to 0.10%, the balance being iron and incidental impurities.

Japanese Unexamined Patent Application Publication No. 2003-096543 discloses a technique related to a high-strength hot-rolled steel sheet having high bake hardenability at high prestrain, the steel sheet containing, in mass percent, 0.0005% to 0.3% of carbon, 0.001% to 3.0% of silicon, 0.01% to 3.0% of manganese, 0.0001% to 0.3% of aluminum, 0.0001% to 0.1% of sulfur, and 0.0010% to 0.05% of nitrogen, the balance being iron and incidental impurities, wherein ferrite has the largest area fraction, dissolved carbon, Sol. C, and dissolved nitrogen, Sol. N, satisfy Sol.C/Sol.N=0.1 to 100, and the average or each of the amounts of increase in yield strength and tensile strength after prestraining to 5% to 20% and baking at 110° C. to 200° C. for 1 to 60 minutes is 50 MPa or more as compared to the steel sheet before prestraining and baking.

However, the known techniques described above have the following problems.

The steels described in JP '668, JP '112 and JP '518, which contain molybdenum, noticeably increase cost because the price of molybdenum has been rising recently. In addition, steel sheets for automotive applications have been used in severely corrosive environments in foreign countries as the automotive industry has globalized, which demands higher corrosion resistance after coating of steel sheets. The addition of molybdenum, however, cannot meet the above demand because it impairs formation or growth of conversion crystals, thus decreasing the corrosion resistance after coating of the steel sheets. Therefore, the steels described in JP '668, JP '112 and JP '518 do not satisfactorily meet the recent demand in the automotive industry.

On the other hand, a working process including, in sequence, drawing or stretch forming, piercing, and flange forming has been employed with the recent advances in pressing technology. This working process requires the portion of a steel sheet subjected to stretch flanging to have stretch flangeability after drawing or stretch forming and piercing, that is, after working. The steels described in JP '668, JP '112, JP '518, JP '046, JP '406, JP '567, JP '138, JP '139, JP '319, JP '444, JP '120 and JP '543, however, do not necessarily have sufficient stretch flangeability after working because this property has only recently been noted.

Among the common techniques for strengthening steel is precipitation strengthening. It is known that the amount of precipitation strengthening is inversely proportional to the grain size of precipitates and is proportional to the square root of the amount of precipitate. For example, the steels disclosed in JP '668, JP '112, JP '518, JP '046, JP '406, JP '567, JP '138, JP '139, JP '319, JP '444, JP '120 and JP '543 contain carbonitride-forming elements such as titanium, vanadium, and niobium; particularly, JP '138, JP '319 and JP '444 have conducted research on the size of precipitates. However, the amount of precipitate is not necessarily sufficient. A high cost due to low precipitation efficiency is problematic.

Niobium, added in JP '112, JP '406 and JP '120, significantly inhibits recrystallization of austenite after hot rolling. This causes a problem in that it leaves unrecrystallized grains in the steel, thus decreasing workability, and also causes a problem in that the rolling load in hot rolling is increased.

In light of the above circumstances, it could be helpful to provide a high-strength steel sheet having excellent stretch flangeability after working and a method for manufacturing such a steel sheet.

As a result of our study in providing a high-strength steel sheet having excellent stretch flangeability after working and a tensile strength of 980 MPa or more, we discovered the following findings:

(i) To provide a high-strength steel sheet, it is necessary to form fine precipitates (less than 20 nm in size) and to increase the proportion of fine precipitates (less than 20 nm in size). Fine precipitates that can be maintained include those containing titanium-molybdenum or titanium-vanadium. In view of alloy cost, composite precipitation of titanium and vanadium is useful.

(ii) Stretch flangeability after working improves if the difference in hardness between the ferrite phase and a second phase is −300 to 300. In addition, a structure having excellent stretch flangeability after working can be formed by controlling first cooling stop temperature T1 and coiling temperature T2 to the respective optimal ranges.

We thus provide:

[1] A high-strength steel sheet having a composition containing, in mass percent, 0.08% to 0.20% of carbon, 0.2% to 1.0% of silicon, 0.5% to 2.5% of manganese, 0.04% or less of phosphorus, 0.005% or less of sulfur, 0.05% or less of aluminum, 0.07% to 0.20% of titanium, and 0.20% to 0.80% of vanadium, the balance being iron and incidental impurities, the steel sheet having a metallographic structure including 80% to 98% by volume of a ferrite phase and a second phase, wherein the sum of the amounts of titanium and vanadium contained in precipitates having a size of less than 20 nm is 0.150% by mass or more, and the difference ($HV_\alpha$–$HV_S$) between the hardness ($HV_\alpha$) of the ferrite phase and the hardness ($HV_S$) of the second phase is −300 to 300.

[2] The high-strength steel sheet in [1] above, wherein the amount of titanium contained in precipitates having a size of less than 20 nm is 0.150% by mass or more.

[3] The high-strength steel sheet in [1] above, wherein the amount of vanadium contained in precipitates having a size of less than 20 nm is 0.550% by mass or more.

[4] The high-strength steel sheet in one of [1] to [3] above, further containing, in mass percent, one or more of 0.01% to 1.0% of chromium, 0.005% to 1.0% of tungsten, and 0.0005% to 0.05% of zirconium.

[5] A method for manufacturing a high-strength steel sheet, including heating to a temperature of 1,150° C. to 1,350° C. a steel slab having a composition containing, in mass percent, 0.08% to 0.20% of carbon, 0.2% to 1.0% of silicon, 0.5% to 2.5% of manganese, 0.04% or less of phosphorus, 0.005% or less of sulfur, 0.05% or less of aluminum, 0.07% to 0.20% of titanium, and 0.20% to 0.80% of vanadium, the balance being iron and incidental impurities, hot-rolling the steel slab at a finish rolling temperature of 850° C. to 1,000° C., subjecting the hot-rolled steel sheet to first cooling to a temperature of 650° C. to lower than 800° C. at an average cooling rate of 30° C./s or higher, cooling the steel sheet with air for one to less than five seconds, subjecting the steel sheet to second cooling at a cooling rate of 20° C./s or higher, and coiling the steel sheet at a temperature of higher than 200° C. to 550° C., wherein inequality (1) is satisfied:

$$T1 \leq 0.06 \times T2 + 764 \quad \text{inequality (1)}$$

wherein T1 is first cooling stop temperature (° C.) and T2 is coiling temperature (° C.).

[6] The method for manufacturing a high-strength steel sheet in [5] above, wherein the composition further contains, in mass percent, one or more of 0.01% to 1.0% of chromium, 0.005% to 1.0% of tungsten, and 0.0005% to 0.05% of zirconium.

The percentages used herein for steel compositions are all expressed by mass. In addition, the term "high-strength steel sheet" as used herein refers to a steel sheet having a tensile strength (hereinafter also referred to as "TS") of 980 MPa or more and includes hot-rolled steel sheets and those subjected to surface treatment such as plating, that is, surface-treated steel sheets.

In addition, we achieve stretch flangeability ($\lambda_{10}$) of 40% or more after rolling to an elongation of 10%.

Accordingly, a high-strength steel sheet having excellent stretch flangeability after working and a TS of 980 MPa or more can be provided. Our steel sheets and methods allow for cost reduction because the above advantages are achieved without adding molybdenum. When used for applications such as automotive chassis, frames for trucks, and impact members, our high-strength steel sheet allows a reduction in thickness, thus reducing the effects of automobiles on the environment, and significantly improves crashworthiness.

DETAILED DESCRIPTION

Figure 1:
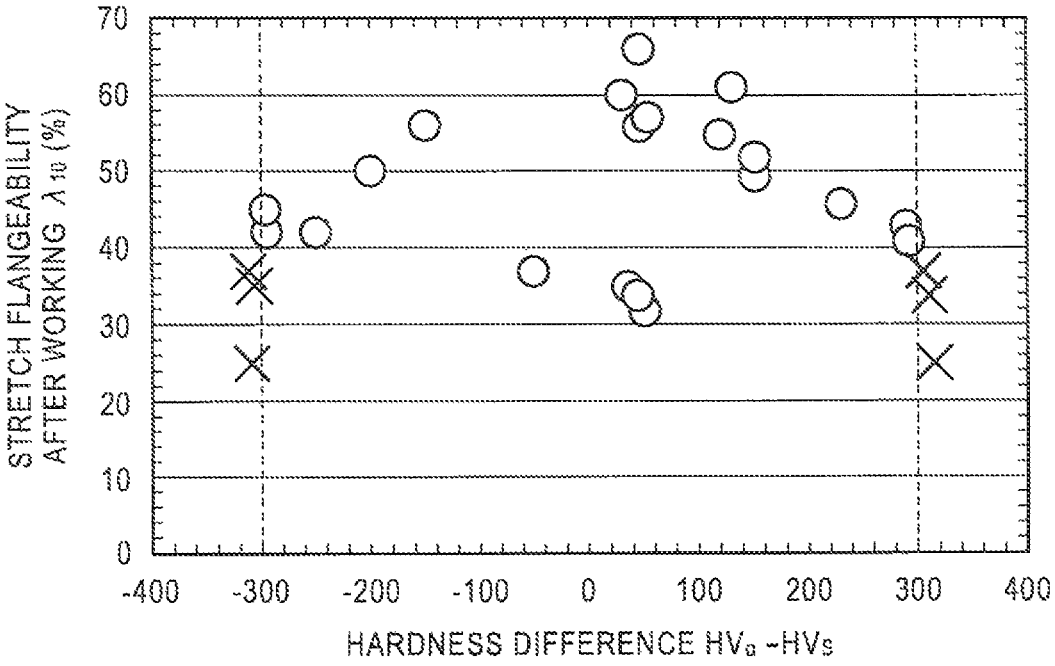
FIG. 1 is a graph showing the relationship between hardness difference ($HV_\alpha$–$HV_S$) and stretch flangeability after working.

In addition to the compositional limitations described later, a high-strength steel sheet is characterized in that the metallographic structure thereof includes 80% to 98% by volume of a ferrite phase and a second phase, in that the sum of the amounts of titanium and vanadium contained in precipitates having a size of less than 20 nm is 0.150% by mass or more, and in that the difference ($HV_\alpha$–$HV_S$) between the hardness ($HV_\alpha$) of the ferrite phase and the hardness ($HV_S$) of the second phase is −300 to 300.

Thus, in addition to the compositional limitations and the structural fractions, we provide that the amounts of titanium and vanadium contained in precipitates having a size of less than 20 nm and the hardness difference ($HV_\alpha$–$HV_S$). With these specified properties, which are the most important requirements, a high-strength steel sheet is provided that has excellent stretch flangeability after working and a TS of 980 MPa or more.

Next, our steel sheets and methods will be described in more detail based on experimental results.

We found that the hardness difference ($HV_\alpha$–$HV_S$) is important for improved stretch flangeability after working Therefore, the hardness difference ($HV_\alpha$–$HV_S$) and the stretch flangeability after working were examined.

Steels of compositions containing 0.09% to 0.185% by mass of carbon, 0.70% to 0.88% by mass of silicon, 1.00% to 1.56% by mass of manganese, 0.01% by mass of phosphorus, 0.0015% by mass of sulfur, 0.03% by mass of aluminum, 0.090% to 0.178% by mass of titanium, and 0.225% to 0.770% by mass of vanadium, with the balance being iron and incidental impurities, were prepared in a converter and were continuously cast into steel slabs. The steel slabs were then heated at a slab heating temperature of 1,250° C. and were hot-rolled at a finishing temperature of 890° C. to 950° C. The steel sheets were then subjected to first cooling to 635° C. to 810° C. at a cooling rate of 55° C./s, were cooled with air for two to six seconds, were subjected to second cooling at a cooling rate of 40° C./s, and were coiled at 250° C. to 600° C. to form hot-rolled steel sheets having a thickness of 2.0 mm. The resulting hot-rolled steel sheets were examined for the difference ($HV_\alpha$–$HV_S$) between the hardness ($HV_\alpha$) of the ferrite phase and the hardness ($HV_S$) of a second phase and stretch flangeability after working.

Vickers hardness was used as the difference ($HV_\alpha$–$HV_S$) between the hardness of the ferrite phase ($HV_\alpha$) and the hardness of a second phase ($HV_S$). The tester used for the Vickers hardness test was one complying with JIS B7725. A sample for structural examination was taken, the structure thereof was developed with a 3% natal solution in a cross section parallel to the rolling direction, and dents were made on ferrite grains and second phases at a position one-fourth of the thickness at a test load of 3 g. The hardness was calculated from the diagonal length of the dents using the Vickers hardness calculation formula in JIS Z2244. The hardnesses of 30 ferrite grains and 30 second phases were measured, and the averages thereof were used as the hardness ($HV_\alpha$) of the ferrite phase and the hardness ($HV_S$) of the second phase to determine the hardness difference ($HV_\alpha$–$HV_S$).

As the stretch flangeability after working, $\lambda_{10}$ was determined by taking three specimens for a hole expanding test, rolling the specimens to an elongation of 10%, carrying out a hole expanding test according to Japan Iron and Steel Federation Standard JFS T1001, and calculating the average of the three pieces.

The results thus obtained are shown in FIG. 1. According to FIG. 1, the steels having a hardness difference ($HV_\alpha$–$HV_S$) of −300 to 300 (indicated by the circles) tended to have excellent stretch flangeability after working and, except some of them, had a stretch flangeability after working of about 40% or more. The same tendency was found both for the steels in which the second phase was harder than the ferrite phase and for the steels in which the ferrite phase was harder than the second phase as a result of precipitation strengthening. This tendency is probably attributed to a reduction in the amount of void formed during working due to the reduced interphase hardness difference.

However, some hot-rolled steel sheets having a hardness difference ($HV_\alpha$–$HV_S$) of −300 to 300 do not have a stretch flangeability after working of about 40% or more. In FIG. 1, for example, some of the hot-rolled steel sheets having a hardness difference ($HV_\alpha$–$HV_S$) around zero had a stretch flangeability after working of 30% to 40%. Therefore, the materials having poor stretch flangeability after working were examined, and it turned out that they had an extremely low or high volume fraction of ferrite than the materials having excellent stretch flangeability after working. Therefore, the relationship between the volume fraction of ferrite and the stretch flangeability after working was examined next.

Of the hot-rolled steel sheets produced in the above experiment, those having a hardness difference ($HV_\alpha$–$HV_S$) of −300 to 300 were examined for the volume fraction of ferrite as a structural fraction. The volume fraction of ferrite was determined by developing the cross sectional microstructure parallel to the rolling direction with 3% natal, examining the microstructure at a position one-fourth of the thickness using a scanning electron microscope (SEM) at a magnification of 1,500×, and measuring the area fraction of ferrite as the volume fraction using the image processing software "Particle Analysis II" manufactured by Sumitomo Metal Technology Inc.

Figure 2:
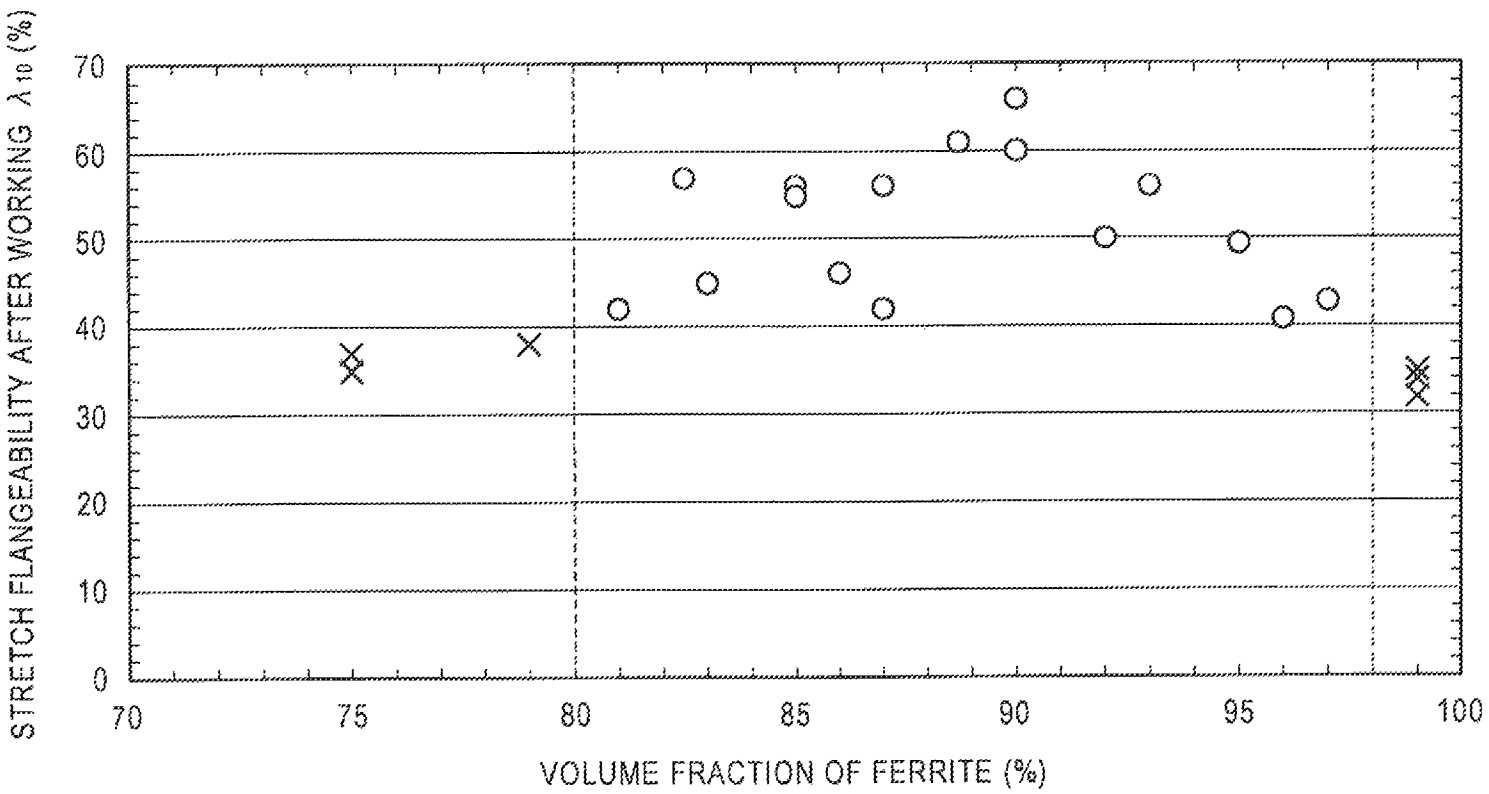
FIG. 2 is a graph showing the relationship between volume fraction of ferrite and stretch flangeability after working.

The obtained results are shown in FIG. 2. According to FIG. 2, the steels having a volume fraction of ferrite of 80% to 98% (indicated by the circles) had a stretch flangeability after working of 40% or more.

The above results demonstrated that it is important to specify the volume fraction of ferrite as well as the difference ($HV_\alpha$–$HV_S$) between the hardness of the ferrite phase ($HV_\alpha$) and the hardness of the second phase ($HV_S$) to achieve excellent stretch flangeability after working and that stretch flangeability after working of 40% or more is ensured if the difference ($HV_\alpha$–$HV_S$) between the hardness of the ferrite phase ($HV_\alpha$) and the hardness of the second phase is −300 to 300 and the volume fraction of ferrite is 80% to 98%.

The reason why stretch flangeability after working improves if the hardness difference ($HV_\alpha$–$HV_S$) and the volume fraction of ferrite are specified as described above is assumed as follows. If the volume fraction of ferrite exceeds 98%, although the reason is unclear, the stretch flangeability after working does not improve probably because numerous voids are formed at interfaces between ferrite phases. On the other hand, if the volume fraction of ferrite falls below 80%, stretch flangeability after working does not improve probably because extended second phases tend to form, joining together voids formed at interfaces between the ferrite phases and the second phases during working.

In addition to stretch flangeability after working, we achieve a high strength, namely, TS≥980. Therefore, means for achieving high strength were examined next. As a result, as described above, we found that it is necessary to form fine precipitates (less than 20 nm in size) and to increase the proportion of fine precipitates (less than 20 nm in size) to provide a high-strength steel sheet. Precipitates having a size of not less than 20 nm may result in low strength because they have little effect on inhibiting movement of dislocations and cannot therefore sufficiently harden ferrite. Accordingly, the size of the precipitates is preferably less than 20 nm. Fine precipitates having a size of less than 20 nm are achieved if the steel contains titanium and vanadium. Titanium and vanadium form carbides independently or together. Although the reason is unclear, we found that these precipitates remain fine stably at elevated temperatures within our range of coiling temperature for an extended period of time.

In the high-strength steel sheet, the precipitates containing titanium and/or vanadium form in ferrite mainly as carbides. This is probably because the solid solubility limit of carbon in ferrite is lower than that in austenite and supersaturated carbon tends to precipitate in ferrite as carbides. These precipitates harden (strengthen) ferrite, which is soft, thus achieving a TS of 980 MPa or more.

Therefore, of the hot-rolled steel sheets produced in the above experiment, those having a hardness difference ($HV_\alpha$–$HV_S$) of −300 to 300 and a volume fraction of ferrite of 80% to 98% were examined for the amounts of titanium and vanadium contained in precipitates having a size of less than 20 nm.

Figure 3:
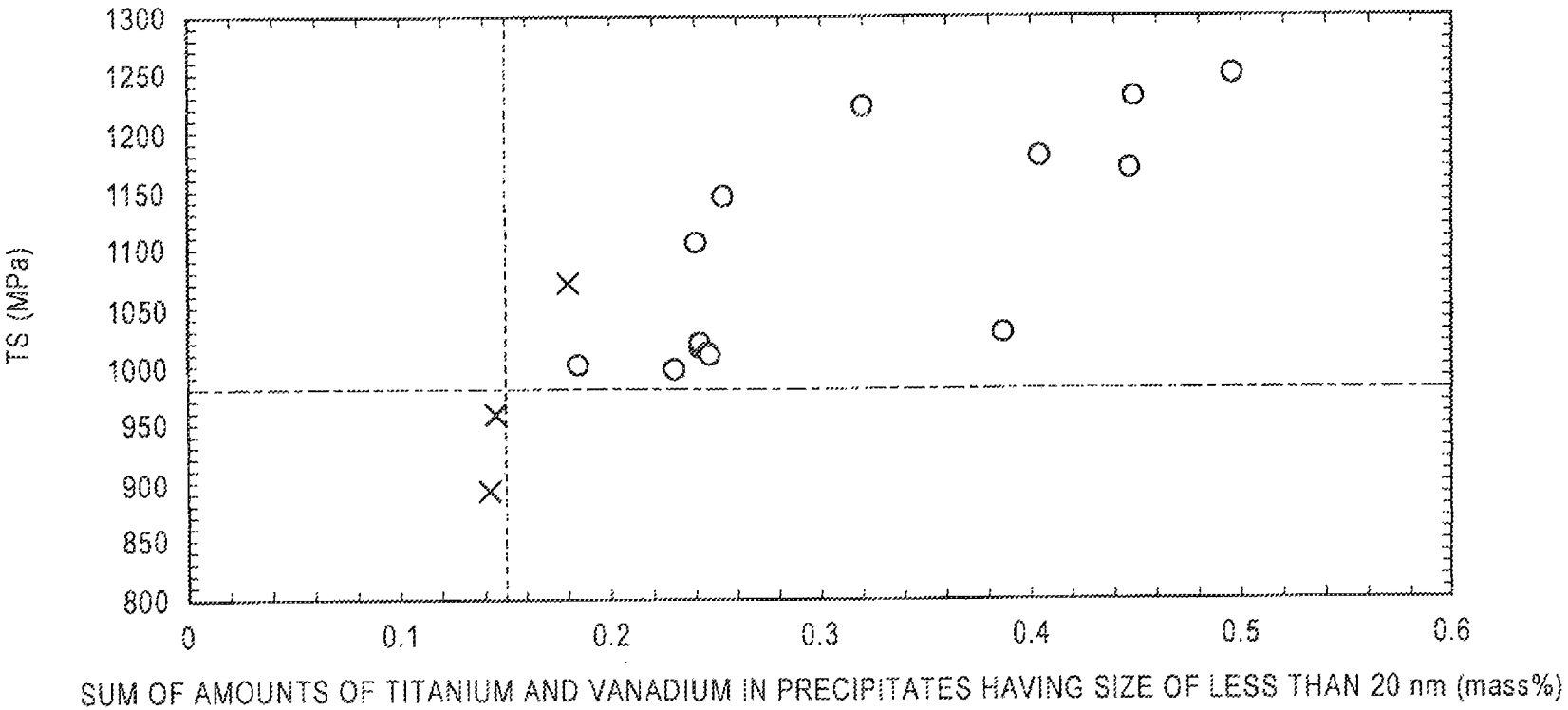
FIG. 3 is a graph showing the relationship between the sum of the amounts of titanium and vanadium contained in precipitates having a size of less than 20 nm and TS.
Figure 4:
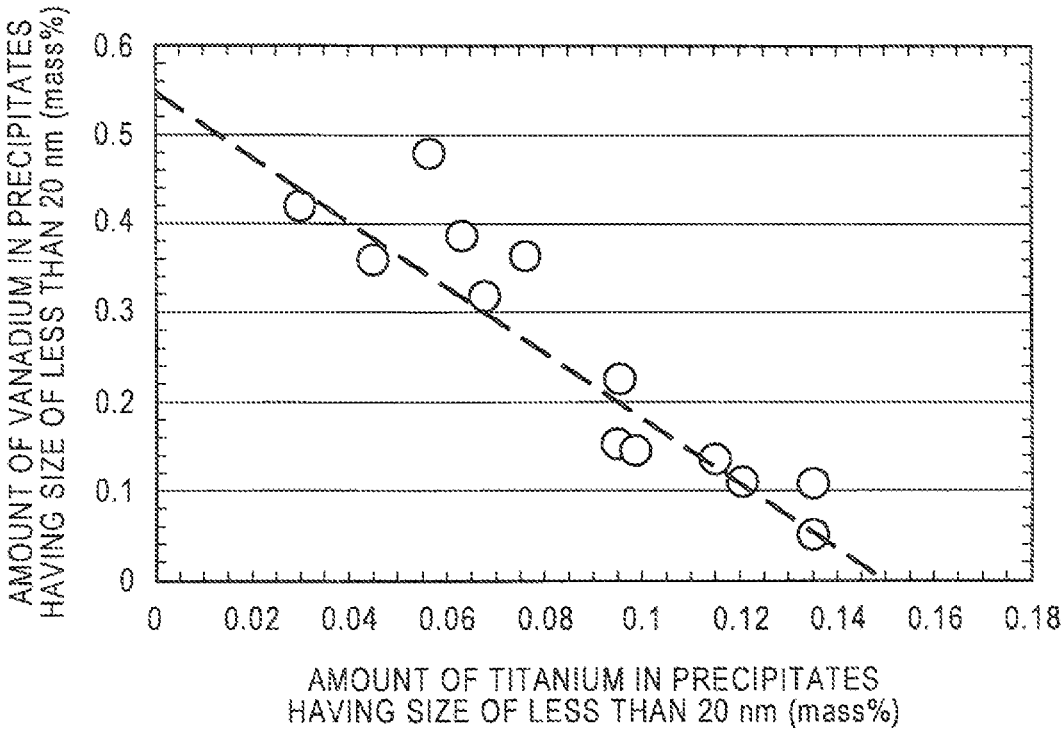
FIG. 4 is a graph showing the relationship between the amounts of titanium and vanadium contained in precipitates having a size of less than 20 nm.

FIG. 3 shows the relationship between the sum of the amounts of titanium and vanadium contained in precipitates having a size of less than 20 nm and TS. FIG. 4 shows the relationship between the amounts of titanium and vanadium contained in precipitates having a size of less than 20 nm. In FIG. 4, only data having a TS of 980 MPa or more in FIG. 3 is cited.

According to FIG. 3, a TS of 980 MPa or more is achieved if the sum of the amounts of titanium and vanadium contained in precipitates having a size of less than 20 nm is 0.150% by mass or more (indicated by the circles). A TS of 980 MPa or more is not achieved if the sum of the amounts of titanium and vanadium contained in precipitates having a size of less than 20 nm is less than 0.150% by mass, probably because ferrite cannot be sufficiently hardened because the number density of the precipitates is decreased, the distances between the precipitates are increased, and therefore the effect of inhibiting movement of dislocations is decreased.

Accordingly, the structure includes 80% to 98% by volume of ferrite, the sum of the amounts of titanium and vanadium contained in precipitates having a size of less than 20 nm is 0.150% or more, and the difference ($HV_\alpha$–$HV_S$) between the hardness of the ferrite phase ($HV_\alpha$) and the hardness of the second phase ($HV_S$) is −300 to 300.

FIG. 4 shows the relationship between the amounts of titanium and vanadium contained in precipitates having a size of less than 20 nm. According to the results in FIGS. 3 and 4, advantages are achieved if the sum of the amounts of titanium and vanadium contained in precipitates having a size of less than 20 nm is 0.150% or more, even if the amount of vanadium is 0% by mass, that is, titanium precipitates alone, rather than together with vanadium. Similarly, advantages are achieved even if the amount of titanium is 0% by mass, that is, vanadium precipitates alone.

According to FIG. 4, the amount of titanium contained in precipitates having a size of less than 20 nm is 0.150% or more if the amount of vanadium contained in precipitates having a size of less than 20 nm is 0% by mass, and the amount of vanadium contained in precipitates having a size of less than 20 nm is 0.550% or more if the amount of titanium contained in precipitates having a size of less than 20 nm is 0% by mass.

Next, the reasons for the limitations on the chemical composition (composition) of the steel will be described.

Carbon: 0.08% to 0.20% by mass

Carbon is an element that forms carbides with titanium and vanadium to precipitate in ferrite, thus contributing to strengthening of the steel sheet. The amount of carbon needs to be 0.08% by mass or more to achieve a TS of 980 MPa or more. On the other hand, if the amount of carbon exceeds 0.20% by mass, the precipitates become coarse, thus decreasing the stretch flangeability. Accordingly, the amount of carbon is 0.08% to 0.20% by mass, preferably 0.09% to 0.18% by mass.

Silicon: 0.2% to 1.0% by mass

Silicon is an element that contributes to facilitation of ferrite transformation and solid-solution strengthening. Therefore, the amount of silicon is 0.2% by mass. However, if the amount thereof exceeds 1.0% by mass, the surface properties of the steel sheet deteriorate noticeably, thus decreasing corrosion resistance. Therefore, the upper limit of the amount of silicon is 1.0% by mass. Accordingly, the amount of silicon is 0.2% to 1.0% by mass, preferably 0.3% to 0.9% by mass.

Manganese: 0.5% to 2.5% by mass

Manganese is an element that contributes to solid-solution strengthening. However, if the amount thereof falls below 0.5% by mass, a TS of 980 MPa or more is not achieved. On the other hand, if the amount thereof exceeds 2.5% by mass, it noticeably decreases weldability. Accordingly, the amount of manganese is 0.5% to 2.5% by mass, preferably 0.5% to 2.0% by mass, and still more preferably, 0.8% to 2.0% by mass.

Phosphorus: 0.04% by mass or less

Phosphorus segregates at prior-austenite grain boundaries, thus degrading low-temperature toughness and decreasing workability. Accordingly, it is preferable to minimize the amount of phosphorus. Therefore, the amount of phosphorus is 0.04% by mass or less.

Sulfur: 0.005% by mass or less

If sulfur segregates at prior-austenite grain boundaries or precipitates as MnS in large amounts, it decreases the low-temperature toughness and also noticeably decreases the stretch flangeability irrespective of whether working is carried out or not. Accordingly, it is preferable to minimize the amount of sulfur. Therefore, the amount of sulfur is 0.005% by mass or less.

Aluminum: 0.05% by mass or less

Aluminum, which is added to the steel as a deoxidizing agent, is an element effective in improving the cleanliness of the steel. To achieve this effect, the steel preferably contains 0.001% by mass or more of aluminum. However, if the amount thereof exceeds 0.05% by mass, large amounts of inclusions form, thus causing defects in the steel sheet. Therefore, the amount of aluminum is 0.05% by mass or less. More preferably, the amount of aluminum is 0.01% to 0.04% by mass.

Titanium: 0.07% to 0.20% by mass

Titanium is an element of great importance for precipitation strengthening of ferrite. If the amount thereof falls below 0.07% by mass, it is difficult to ensure the necessary strength. On the other hand, if the amount thereof exceeds 0.20% by mass, the effect thereof is saturated, only ending up increasing the cost. Accordingly, the amount of titanium is 0.07% to 0.20% by mass, preferably 0.08% to 0.18% by mass.

Vanadium: 0.20% to 0.80% by mass

Vanadium is an element that contributes to increased strength by precipitation strengthening or solid-solution strengthening and, along with titanium, described above, is an important requirement for achieving our advantages. An appropriate amount of vanadium contained together with titanium tends to precipitate as fine titanium-vanadium carbides having a grain size of less than 20 nm and, unlike molybdenum, does not decrease the corrosion resistance after coating. In addition, vanadium is less costly than molybdenum. If the amount of vanadium falls below 0.20% by mass, the above effect provided by containing it is insufficient. On the other hand, if the amount of vanadium exceeds 0.80% by mass, the effect thereof is saturated, only ending up increasing the cost. Accordingly, the amount of vanadium is 0.20% to 0.80% by mass, preferably 0.25% to 0.60% by mass.

The steel achieves the intended properties by containing the elements described above, although in addition to the above elements contained, it may further contain one or more of 0.01% to 1.0% by mass of chromium, 0.005% to 1.0% by mass of tungsten, and 0.0005% to 0.05% by mass of zirconium for the following reasons.

Chromium: 0.01% to 1.0% by mass; tungsten: 0.005% to 1.0% by mass; zirconium: 0.0005% to 0.05% by mass Chromium, tungsten, and zirconium serve to strengthen ferrite by forming precipitates or in a solid solution state, as does vanadium. If the amount of chromium falls below 0.01% by mass, the amount of tungsten falls below 0.005% by mass, or the amount of zirconium falls below 0.0005% by mass, they hardly contribute to increased strength. On the other hand, if the amount of chromium exceeds 1.0% by mass, the amount of tungsten exceeds 1.0% by mass, or the amount of zirconium exceeds 0.05% by mass, the workability deteriorates. Accordingly, if one or more of chromium, tungsten, zirconium are contained, the chromium content is 0.01% to 1.0% by mass, the tungsten content is 0.005% to 1.0% by mass, and the zirconium content is 0.0005% to 0.05% by mass. Preferably, the chromium content is 0.1% to 0.8% by mass, the tungsten content is 0.01% to 0.8% by mass, and the zirconium content is 0.001% to 0.04% by mass.

The balance other than above is iron and incidental impurities. An example of an incidental impurity is oxygen, which forms nonmetallic inclusions that adversely affect the quality. Therefore, the amount thereof is preferably reduced to 0.003% by mass or less. The steel may also contain copper, nickel, tin, and antimony in an amount of 0.1% by mass or less as trace elements that do not impair the advantageous effects.

Next, the structure of the high-strength steel sheet invention will be described. 80% to 98% of ferrite and second phase To improve the stretch flangeability after working, it is probably effective that the primary phase be ferrite, which has low dislocation density, and the second phase be distributed in an island pattern in the steel sheet. As described above, the volume fraction of ferrite needs to be 80% to 98% for improved stretch flangeability after working. In addition to the experimental results described above, if the volume fraction of ferrite falls below 80%, the stretch flangeability after working ($\lambda_{10}$) and elongation (El) decrease probably because voids formed at interfaces between ferrite phases and second phases tend to be joined together during working. On the other hand, if the volume fraction of ferrite exceeds 98%, although the reason is unclear, the stretch flangeability after working does not improve probably because numerous voids are formed at interfaces between the ferrite phases. Accordingly, the volume fraction of ferrite is 80% to 98%, preferably 85% to 95%.

The second phase, on the other hand, is preferably bainite phase or martensite phase. In addition, it is effective in view of stretch flangeability that the second phase be distributed in an island pattern in the steel sheet.

If the volume fraction of the second phase falls below 2%, the stretch flangeability might not improve because the amount of second phase is insufficient. On the other hand, if the volume fraction exceeds 20%, second phases are joined together during deformation of the steel sheet because the amount of second phase is excessive, which might decrease the stretch flangeability after working ($\lambda_{10}$) and elongation (El). Accordingly, it is more preferable that the volume fraction of ferrite be 2% to 20%.

The volume fractions of ferrite and the second phase are determined by developing a cross sectional microstructure parallel to a rolling direction with 3% natal, examining the microstructure at a position one-fourth of the thickness using a scanning electron microscope (SEM) at a magnification of 1,500×, and measuring the area fractions of ferrite and the second phase as the volume fractions using the image processing software "Particle Analysis II" manufactured by Sumitomo Metal Technology Inc.

Sum of amounts of titanium and vanadium contained in precipitates having size of less than 20 nm is 0.150% by mass or more (where the amounts of titanium and vanadium are the respective concentrations based on 100% by mass of the total composition of the steel)

As described above, the sum of the amounts of titanium and vanadium contained in precipitates having a size of less than 20 nm is 0.150% by mass or more. There is no particular upper limit, although if the sum of the amounts of titanium and vanadium exceeds 1.0% by mass, the steel sheet fractures in a brittle manner and cannot therefore achieve the target properties, although the reason is unclear. Precipitates and/or inclusions are collectively referred to as "precipitates etc."

The amounts of titanium and vanadium contained in precipitates having a size of less than 20 nm can be examined by the following method.

After a predetermined amount of sample is electrolyzed in an electrolytic solution, the sample piece is removed from the electrolytic solution and is immersed in a solution having dispersing ability. Precipitates contained in the solution are then filtered through a filter having a pore size of 20 nm. The precipitates passing through the filter having a pore size of 20 nm together with the filtrate have a size of less than 20 nm. After filtration, the filtrate is subjected to an analysis appropriately selected from, for example, inductively coupled plasma (ICP) emission spectrometry, ICP mass spectrometry, and atomic absorption spectrometry to determine the amounts in the precipitates having a size of less than 20 nm.

Difference ($HV_\alpha$–$HV_S$) between hardness ($HV_\alpha$) of ferrite phase and hardness ($HV_S$) of second phase is −300 to 300

As described above, the difference ($HV_\alpha$–$HV_S$) between the hardness ($HV_\alpha$) of the ferrite phase and the hardness ($HV_S$) of the second phase is −300 to 300. If the hardness difference falls below −300 or exceeds 300, the required stretch flangeability after working is not achieved because more cracks occur at interfaces between ferrite phases and second phases due to the large difference in strain between the ferrite phases and the second phases after working. The hardness difference is preferably of smaller absolute value, preferably, −250 to 250.

Next, a method for manufacturing the high-strength steel sheet will be described.

The steel sheet is manufactured by, for example, heating a steel slab adjusted to the above ranges of chemical composition to a temperature of 1,150° C. to 1,350° C., hot-rolling the steel slab at a finish rolling temperature of 850° C. to 1,000° C., subjecting the steel sheet to first cooling to a temperature of 650° C. to lower than 800° C. at an average cooling rate of 30° C./s or higher, cooling the steel sheet with air for one to less than five seconds, subjecting the steel sheet to second cooling at a cooling rate of 20° C./s or higher, and coiling the steel sheet at a temperature of higher than 200° C. to 550° C. such that inequality (1) is satisfied:

$$T1 \leq 0.06 \times T2 + 764 \qquad \text{inequality (1)}$$

wherein T1 is the first cooling stop temperature (° C.) and T2 is the coiling temperature (° C.).

These conditions will now be described in detail.

Slab heating temperature: 1,150° C. to 1,350° C.

The carbide-forming elements, such as titanium and vanadium, are mostly present as carbides in the steel slab. To precipitate carbides in ferrite after hot rolling as intended, carbides precipitated before hot rolling need to be dissolved. This requires heating at 1,150° C. or higher. On the other hand, the heating temperature is 1,350° C. or lower because if the steel slab is heated above 1,350° C., the crystal grains become extremely coarse, thus degrading the stretch flangeability after working and the ductility. Accordingly, the slab heating temperature is 1,150° C. to 1,350° C., more preferably 1,170° C. to 1,260° C.

Finish rolling temperature in hot rolling: 850° C. to 1,000° C.

The steel slab after working is hot-rolled at a finish rolling temperature, which is the hot rolling termination temperature, of 850° C. to 1,000° C. If the finish rolling temperature falls below 850° C., an extended ferrite structure is formed because the steel slab is rolled in the ferrite+austenite region, thus degrading the stretch flangeability and the ductility. On the other hand, if the finish rolling temperature exceeds 1,000° C., a TS of 980 MPa is not achieved because the ferrite grains become coarse. Accordingly, the finish rolling is performed at a finish rolling temperature of 850° C. to 1,000° C.

More preferably, the finish rolling temperature is 870° C. to 960° C.

First cooling: cooled to cooling stop temperature of 650° C. to lower than 800° C. at average cooling rate of 30° C./s or higher After the hot rolling, the steel sheet needs to be cooled from the finish rolling temperature to a cooling temperature of 650° C. to lower than 800° C. at an average cooling rate of 30° C./s or higher. If the cooling stop temperature is not lower than 800° C., the volume fraction of ferrite does not reach 80% because nucleation does not tend to occur, which makes it impossible to provide the intended precipitation state of precipitates containing titanium and/or vanadium. If the cooling stop temperature falls below 650° C., the volume fraction of ferrite does not reach 80% because the diffusion rates of carbon and titanium decrease, which makes it impossible to provide the intended precipitation state of precipitates containing titanium and/or vanadium. Accordingly, the cooling stop temperature is 650° C. to lower than 800° C. In addition, if the average cooling rate from the finish rolling temperature to the cooling stop temperature falls below 30° C./s, the stretch flangeability after working and the ductility deteriorate because pearlite forms. The upper limit of the cooling rate is preferably, but not limited to, about 300° C./s to accurately stop the cooling within the above range of cooling stop temperature.

Air cooling after first cooling: one to less than five seconds

After the first cooling, the cooling is stopped to allow the steel sheet to be cooled with air for one to less than five seconds. If the air cooling time falls below one second, the volume fraction of ferrite does not reach 80%; if the air cooling time exceeds more than five seconds, the stretch flangeability and the ductility deteriorate because pearlite forms. The cooling rate during the air cooling is about 15° C./s or lower.

Second cooling: cooled to coiling temperature of higher than 200° C. to 550° C. at average cooling rate of 20° C./s or higher After the air cooling, second cooling is performed to a coiling temperature of higher than 200° C. to 550° C. at an average cooling rate of 20° C./s or higher. The average cooling rate is 20° C./s or higher, preferably 50° C./s or higher, because pearlite forms during the cooling if the cooling rate falls below 20° C./s. The upper limit of the cooling rate is preferably, but not limited to, about 300° C./s to accurately stop the cooling within the above range of coiling temperature.

In addition, if the coiling temperature is not higher than 200° C., the steel sheet has a poor shape. On the other hand, if the coiling temperature is higher than 550° C., the stretch flangeability deteriorates because pearlite forms. Moreover, the hardness difference could be higher than 300. Preferably, the coiling temperature is 400° C. to 520° C.

$T1 \leq 0.06 \times T2 + 764$ wherein T1 is the first cooling stop temperature (° C.) and T2 is the coiling temperature (° C.)

During the air cooling after the first cooling, fine precipitates form in ferrite. This allows most of the ferrite phase to be precipitation-strengthened. The hardness of the precipitation-strengthened ferrite phase depends on the temperature at which the precipitates form, that is, the first cooling stop temperature. The hardness of the second phase, on the other hand, depends on the transformation temperature, that is, the coiling temperature. As a result of various studies, it has turned out that the hardness difference is −300 to 300 if, letting the first cooling stop temperature be T1 (° C.) and the coiling temperature be T2 (° C.), $T1 \leq 0.06 \times T2 + 764$ is satisfied. For $T1 > 0.06 \times T2 + 764$, the hardness difference falls below −300 because the ferrite phase has low hardness and the second phase has high hardness.

Thus, a high-strength steel sheet having excellent stretch flangeability after working is provided. Steel sheets include surface-treated or surface-coated steel sheets. In particular, a steel sheet is suitable for use as a hot-dip galvanized steel sheet by forming a hot-dip galvanized coating. That is, a steel sheet which has good workability can maintain its good workability after a hot-dip galvanized coating is formed. The term "hot-dip galvanizing" refers to hot-dip coating with zinc or a zinc-based alloy (i.e., containing about 90% or more of zinc) and includes coating with an alloy containing an alloying element other than zinc, such as aluminum or chromium. In addition, alloying treatment may be performed after the hot-dip galvanizing.

In addition, there is no particular limitation on the method for preparing the steel, and all known methods for preparation can be applied. An example of a preferred method for preparation is one in which the steel is prepared in, for example, a converter or electric furnace and is subjected to secondary refining in a vacuum degassing furnace. The casting method is preferably continuous casting in terms of productivity and quality. In addition, the advantages are not affected even if the steel is subjected to direct rolling, that is, even if the steel is directly hot-rolled immediately after casting or after the steel is heated to add more heat. Furthermore, a hot-rolled sheet after rough rolling may be heated before finish rolling, and the advantages are not impaired even if continuous hot rolling is performed by joining rolled sheets together after rough rolling or even if heating of rolled sheets and continuous rolling are simultaneously performed.

EXAMPLE 1

Steels of the compositions shown in Table 1 were prepared in a converter and were continuously cast into steel slabs. These steel slabs were then heated, hot-rolled, cooled, and coiled under the conditions shown in Tables 2 and 3 to produce hot-rolled steel sheets having a thickness of 2.0 mm. The coiling temperature shown in Tables 2 and 3 is an average of coiling temperatures measured longitudinally in the center of the steel strip across the width.

TABLE 1

| Type of steel | Composition (mass %) | | | | | | | | Remarks |
|---|---|---|---|---|---|---|---|---|---|
| | C | Si | Mn | P | S | Al | Ti | V | |
| A | 0.110 | 0.70 | 1.00 | 0.01 | 0.0015 | 0.03 | 0.130 | 0.300 | Conforming steel |
| B | 0.150 | 0.74 | 1.02 | 0.01 | 0.0015 | 0.03 | 0.155 | 0.600 | Conforming steel |
| C | 0.135 | 0.75 | 1.01 | 0.01 | 0.0015 | 0.03 | 0.178 | 0.230 | Conforming steel |
| D | 0.125 | 0.84 | 1.20 | 0.01 | 0.0015 | 0.03 | 0.130 | 0.770 | Conforming steel |
| E | 0.123 | 0.80 | 1.21 | 0.01 | 0.0015 | 0.03 | 0.125 | 0.500 | Conforming steel |
| F | 0.185 | 0.85 | 1.35 | 0.01 | 0.0015 | 0.03 | 0.165 | 0.225 | Conforming steel |
| G | 0.090 | 0.88 | 1.56 | 0.01 | 0.0015 | 0.03 | 0.090 | 0.750 | Conforming steel |
| H | 0.065 | 0.72 | 1.04 | 0.01 | 0.0015 | 0.03 | 0.085 | 0.205 | Nonconforming |

The resulting hot-rolled steel sheets were examined for the amounts of titanium and vanadium contained in precipitates having a size of less than 20 nm by the following method.

Measurement of Amounts of Titanium and Vanadium Contained in Precipitates Having Size of Less than 20 nm The hot-rolled steel sheets thus produced were cut to an appropriate size, and about 0.2 g was electrolyzed with constant current at a current density of 20 mA/cm$^2$ in a 10% AA electrolytic solution (10% by volume acetylacetone-1% by mass tetramethyl-ammonium chloride-methanol).

After the electrolysis, the sample piece, which had precipitates thereon, was removed from the electrolytic solution, was immersed in a sodium hexametaphosphate aqueous solution (500 mg/L) (hereinafter referred to as "SHMP aqueous solution"), and was subjected to ultrasonic vibration to release the precipitates from the sample piece into the SHMP aqueous solution. The SHMP aqueous solution containing the precipitates was then filtered through a filter having a pore size of 20 nm, and the filtrate after the filtration was analyzed using an ICP emission spectrometer to measure the absolute amounts of titanium and vanadium in the filtrate. The absolute amounts of titanium and vanadium were then divided by the electrolyzed weight to determine the amounts of titanium and vanadium contained in precipitates having a size of less than 20 nm (% by mass based on 100% by mass of the total composition of the sample). The electrolyzed weight was determined by measuring the weight of the sample after the release of the precipitates and subtracting it from the weight of the sample before the electrolysis.

In addition, JIS No. 5 tensile specimens (parallel to the rolling direction), hole expanding specimens, and a sample for structural examination were taken from each coil at a position 30 m from an end thereof in the center across the width, and the tensile strength TS, the elongation El, the stretch flangeability after working $\lambda_{10}$, and the hardness difference $HV_\alpha$–$HV_S$ were determined and evaluated by the following methods.

Tensile Strength TS, Elongation El

The tensile strength (TS) and the elongation (El) were determined by taking three JIS No. 5 tensile specimens such that the tensile direction was the rolling direction and carrying out a tensile test by a method complying with JIS Z 2241.

Stretch Flangeability After Working $\lambda_{10}$ $\lambda_{10}$ was determined by taking three specimens for a hole expanding test, rolling the specimens to an elongation of 10%, carrying out a hole expanding test according to Japan Iron and Steel Federation Standard JFS T1001, and calculating the average of the three pieces.

Hardness Difference $HV_\alpha$–$HV_S$

The tester used for a Vickers hardness test was one complying with JIS B7725. A sample for structural examination was taken, the structure thereof was developed with a 3% natal solution in a cross section parallel to the rolling direction, and dents were made on ferrite grains and second phases at a position one-fourth of the thickness at a test load of 3 g.

The hardness was calculated from the diagonal length of the dents using the Vickers hardness test calculation formula in JIS Z2244. The hardnesses of 30 ferrite grains and 30 second phases were measured, and the averages thereof were used as the hardness ($HV_\alpha$) of the ferrite phase and the hardness ($HV_S$) of the second phase to determine the hardness difference ($HV_\alpha$–$HV_S$).

In addition, the volume fractions of ferrite and the second phase were determined by developing the cross sectional microstructure parallel to the rolling direction with 3% natal, examining the microstructure at a position one-fourth of the thickness using a scanning electron microscope (SEM) at a magnification of 1,500×, and measuring the area fractions of ferrite and the second phase as the respective volume fractions using the image processing software "Particle Analysis II" manufactured by Sumitomo Metal Technology Inc.

The results thus obtained are shown in Tables 2 and 3 together with the manufacturing conditions.

TABLE 2

| No | Type of steel | Slab heating temperature (° C.) | Finish rolling temperature (° C.) | First cooling rate (° C./s) | First cooling stop temperature (° C.) | Air cooling time (s) | Second cooling rate (° C./s) | Coiling temperature (° C.) | Tensile strength TS (MPa) | Elongation El (%) | Stretch flangeability after working $\lambda_{10}$ (%) |
|---|---|---|---|---|---|---|---|---|---|---|---|
| 1 | A | 1250 | 910 | 53 | 715 | 2 | 35 | 400 | 1015 | 17 | 60 |
| 2 | A | 1250 | 905 | 52 | 755 | 4 | 37 | 415 | 1010 | 17 | 56 |
| 3 | A | 1250 | 915 | 55 | 655 | 4 | 40 | 405 | 1012 | 17 | 57 |
| 4 | A | 1250 | 906 | 70 | 720 | 3 | 39 | 250 | 1020 | 16 | 56 |
| 8 | B | 1270 | 915 | 55 | 710 | 2 | 41 | 432 | 998 | 16 | 55 |
| 11 | C | 1270 | 950 | 56 | 702 | 3 | 32 | 440 | 1107 | 15 | 46 |
| 12 | D | 1250 | 942 | 70 | 684 | 3 | 34 | 445 | 1251 | 17 | 50 |
| 13 | E | 1250 | 914 | 73 | 724 | 3 | 35 | 450 | 1223 | 17 | 61 |
| 14 | F | 1270 | 930 | 75 | 705 | 3 | 36 | 430 | 1146 | 15 | 52 |
| 15 | G | 1200 | 890 | 54 | 757 | 2 | 35 | 443 | 1030 | 17 | 66 |

| No | Volume fraction of ferrite (%) | Amount of titanium in precipitates having size of less than 20 nm (mass %) | Amount of vanadium in precipitates having size of less than 20 nm (mass %) | Sum of amounts of titanium and vanadium in precipitates having size of less than 20 nm (mass %) | Remaining structure and volume fraction* | Hardness difference $HV_\alpha$ – $HV_S$ | Remarks |
|---|---|---|---|---|---|---|---|
| 1 | 90 | 0.098 | 0.145 | 0.243 | B: 10% | 30 | Example |
| 2 | 85 | 0.095 | 0.152 | 0.247 | B: 15% | 45 | Example |
| 3 | 83 | 0.095 | 0.151 | 0.246 | B: 17% | 52 | Example |
| 4 | 87 | 0.098 | 0.145 | 0.243 | M: 13% | −150 | Example |
| 8 | 85 | 0.120 | 0.110 | 0.230 | B: 15% | 120 | Example |
| 11 | 86 | 0.135 | 0.106 | 0.241 | B: 14% | 230 | Example |

TABLE 2-continued

| | | | | | | | |
|---|---|---|---|---|---|---|---|
| 12 | 95 | 0.076 | 0.365 | 0.441 | B: 5% | 152 | Example |
| 13 | 89 | 0.096 | 0.225 | 0.321 | B: 11% | 130 | Example |
| 14 | 87 | 0.115 | 0.139 | 0.254 | B: 13% | 152 | Example |
| 15 | 90 | 0.068 | 0.320 | 0.388 | B: 10% | 45 | Example |

*In the "remaining structure and volume fraction" column, B denotes bainite, and M denotes martensite.

TABLE 3

| No | Type of steel | Slab heating temperature (° C.) | Finish rolling temperature (° C.) | First cooling rate (° C./s) | First cooling stop temperature (° C.) | Air cooling time (s) | Second cooling rate (° C./s) | Coiling temperature (° C.) | Tensile strength TS (MPa) | Elongation El (%) | Stretch flangeability after working $\lambda_{10}$ (%) |
|---|---|---|---|---|---|---|---|---|---|---|---|
| 5 | A | 1250 | 920 | 50 | 720 | 7 | 35 | 400 | 1024 | 15 | 35 |
| 6 | A | 1250 | 915 | 55 | 630 | 3 | 35 | 540 | 840 | 14 | 37 |
| 7 | A | 1250 | 925 | 54 | 720 | 3 | 36 | 560 | 982 | 16 | 25 |
| 9 | B | 1250 | 927 | 55 | 635 | 3 | 37 | 250 | 1254 | 12 | 25 |
| 10 | B | 1250 | 915 | 56 | 810 | 3 | 35 | 400 | 894 | 18 | 42 |
| 16 | H | 1220 | 923 | 60 | 715 | 3 | 34 | 450 | 878 | 19 | 45 |

| No | Volume fraction of ferrite (%) | Amount of titanium in precipitates having size of less than 20 nm (mass %) | Amount of vanadium in precipitates having size of less than 20 nm (mass %) | Sum of amounts of titanium and vanadium in precipitates having size of less than 20 nm (mass %) | Remaining structure and volume fraction* | Hardness difference $HV_\alpha - HV_S$ | Remarks |
|---|---|---|---|---|---|---|---|
| 5 | 99 | 0.099 | 0.152 | 0.251 | B: 1% | 35 | Comparative Example |
| 6 | 75 | 0.085 | 0.125 | 0.210 | B: 25% | −50 | Comparative Example |
| 7 | 85 | 0.100 | 0.163 | 0.263 | P: 15% | 315 | Comparative Example |
| 9 | 63 | 0.092 | 0.135 | 0.227 | M: 37% | −309 | Comparative Example |
| 10 | 93 | 0.041 | 0.102 | 0.143 | B: 7% | −250 | Comparative Example |
| 16 | 95 | 0.063 | 0.077 | 0.140 | B: 5% | −252 | Comparative Example |

*In the "remaining structure and volume fraction" column, B denotes bainite, M denotes martensite, and P denotes pearlite.

According to Table 2, high-strength steel sheets having excellent stretch flangeability after working with a TS (strength) of 980 MPa or more and a $\lambda_{10}$ of 40% or more were provided in the Examples. In addition, the El (elongation) was sufficient, namely, 15% or more.

According to Table 3, in contrast, the Comparative Examples were poor in one or both of TS and $\lambda_{10}$.

EXAMPLE 2

Steels of the compositions shown in Table 4 were prepared in a converter and were continuously cast into steel slabs. These steel slabs were then heated, hot-rolled, cooled, and coiled under the conditions shown in Table 5 to produce hot-rolled steel sheets having a thickness of 2.0 mm. The coiling temperature shown in Table 5 is an average of coiling temperatures measured longitudinally in the center of the steel strip across the width.

TABLE 4

| Type of steel | Composition (mass %) C | Si | Mn | P | S | Al | Ti | V | Others | Remarks |
|---|---|---|---|---|---|---|---|---|---|---|
| I | 0.135 | 0.75 | 1.01 | 0.01 | 0.0015 | 0.03 | 0.178 | 0.230 | Cr: 0.3 | Conforming steel |
| J | 0.110 | 0.70 | 1.00 | 0.01 | 0.0015 | 0.03 | 0.130 | 0.300 | W: 0.2 | Conforming steel |
| K | 0.125 | 0.84 | 1.20 | 0.01 | 0.0015 | 0.03 | 0.130 | 0.770 | Zr: 0.02 | Conforming steel |

The resulting hot-rolled steel sheets were examined for the amounts of titanium and vanadium contained in precipitates having a size of less than 20 nm by the same method as in Example 1. In addition, the tensile strength TS, the elongation El, the stretch flangeability after working $\lambda_{10}$, and the hardness difference $HV_\alpha - HV_S$ were determined and evaluated by the same methods as in Example 1.

The results thus obtained are shown in Table 5 together with the manufacturing conditions.

TABLE 5

| No | Type of steel | Slab heating temperature (° C.) | Finish rolling temperature (° C.) | First cooling rate (° C./s) | First cooling stop temperature (° C.) | Air cooling time (s) | Second cooling rate (° C./s) | Coiling temperature (° C.) | Tensile strength TS (MPa) | Elongation El (%) | Stretch flangeability after working $\lambda_{10}$ (%) |
|---|---|---|---|---|---|---|---|---|---|---|---|
| 17 | I | 1270 | 950 | 56 | 700 | 3 | 32 | 440 | 1125 | 15 | 50 |
| 18 | J | 1250 | 910 | 53 | 718 | 2 | 35 | 400 | 1030 | 17 | 63 |
| 19 | K | 1250 | 940 | 70 | 684 | 3 | 34 | 445 | 1270 | 17 | 52 |

| No | Volume fraction of ferrite (%) | Amount of titanium in precipitates having size of less than 20 nm (mass %) | Amount of vanadium in precipitates having size of less than 20 nm (mass %) | Sum of amounts of titanium and vanadium in precipitates having size of less than 20 nm (mass %) | Remaining structure and volume fraction* | Hardness difference $HV_\alpha - HV_S$ | Remarks |
|---|---|---|---|---|---|---|---|
| 17 | 85 | 0.137 | 0.110 | 0.247 | B: 15% | 220 | Example |
| 18 | 92 | 0.100 | 0.145 | 0.245 | B: 8% | 25 | Example |
| 19 | 95 | 0.080 | 0.355 | 0.435 | B: 5% | 150 | Example |

*In the "remaining structure and volume fraction" column, B denotes bainite.

According to Table 5, high-strength steel sheets having excellent stretch flangeability after working with a TS of 980 MPa or more and a $\lambda_{10}$ of 40% or more were provided in the Examples. Table 5 also shows that the steels containing chromium, tungsten, or zirconium in Example 2 had a higher TS than the steels in Example 1 based on the same compositions.

INDUSTRIAL APPLICABILITY

A steel sheet has high strength and excellent stretch flangeability after working and is therefore best suited to, for example, parts requiring ductility and stretch flangeability, such as frames for automobiles and trucks.

The invention claimed is:

1. A high-strength steel sheet comprising a composition containing, in mass percent, 0.08% to 0.20% of carbon, 0.2% to 1.0% of silicon, 0.5% to 2.5% of manganese, 0.04% or less of phosphorus, 0.005% or less of sulfur, 0.05% or less of aluminum, 0.07% to 0.20% of titanium, and 0.30% to 0.80% of vanadium, the balance being iron and incidental impurities, and having a metallographic structure comprising 80% to 98% by volume of a ferrite phase and a second phase, wherein a sum of amounts of titanium and vanadium contained in precipitates having a size of less than 20 nm is 0.150% by mass or more, and a difference ($HV_\alpha - HV_S$) between hardness ($HV_\alpha$) of the ferrite phase and hardness ($HV_S$) of the second phase is −300 to 300.

2. The high-strength steel sheet according to claim 1, wherein the amount of titanium contained in precipitates having a size of less than 20 nm is 0.150% by mass or more.

3. The high-strength steel sheet according to claim 2, further containing, in mass percent, one or more of 0.01% to 1.0% of chromium, 0.005% to 1.0% of tungsten, and 0.0005% to 0.05% of zirconium.

4. The high-strength steel sheet according to claim 1, wherein the amount of vanadium contained in precipitates having a size of less than 20 nm is 0.550% by mass or more.

5. The high-strength steel sheet according to claim 4, further containing, in mass percent, one or more of 0.01% to 1.0% of chromium, 0.005% to 1.0% of tungsten, and 0.0005% to 0.05% of zirconium.

6. The high-strength steel sheet according to claim 1, further containing, in mass percent, one or more of 0.01% to 1.0% of chromium, 0.005% to 1.0% of tungsten, and 0.0005% to 0.05% of zirconium.

7. A method of manufacturing the high-strength steel sheet according to claim 1, comprising:

heating to a temperature of 1,150° C. to 1,350° C. a steel slab formed from the composition;

hot-rolling the steel slab at a finish rolling temperature of 850° C. to 1,000° C.;

subjecting the hot-rolled steel sheet to first cooling to a temperature of 650° C. to lower than 800° C. at an average cooling rate of 30° C./s or higher;

cooling the steel sheet with air for one to less than five seconds;

subjecting the steel sheet to second cooling at a cooling rate of 20° C./s or higher; and coiling the steel sheet at a temperature of higher than 200° C. to 550° C., wherein inequality (1) is satisfied:

$$T1 \leq 0.06 \times T2 + 764 \quad \text{inequality (1)}$$

wherein T1 is first cooling stop temperature (° C.) and T2 is coiling temperature (° C.).

8. The method according to claim 7, wherein the composition further contains, in mass percent, one or more of 0.01% to 1.0% of chromium, 0.005% to 1.0% of tungsten, and 0.0005% to 0.05% of zirconium.

* * * * *